US005941184A

United States Patent [19]

Casacia et al.

[11] Patent Number: 5,941,184

[45] Date of Patent: Aug. 24, 1999

[54] CONTROLLED THERMAL OXIDATION PROCESS FOR ORGANIC WASTES

[75] Inventors: Lucy Casacia, Hamilton; Barry Knowlton, Brampton; Frank Sherman, Burlington, all of Canada

[73] Assignee: Eco Waste Solutions Inc., Ontario, Canada

[21] Appl. No.: 08/982,500

[22] Filed: Dec. 2, 1997

[51] Int. Cl.[6] ..... F23G 11/00; F23L 1/00; F23J 3/00

[52] U.S. Cl. ..... 110/346; 110/344; 110/348; 110/251; 110/252; 110/210; 110/214; 110/315

[58] Field of Search ..... 110/203, 210, 110/212, 214, 235, 251, 252, 243, 244, 245, 315, 342, 344, 345, 346, 348

[56] References Cited

U.S. PATENT DOCUMENTS

| | | | |
|---|---|---|---|
| 3,595,181 | 7/1971 | Anderson et al. . | |
| 3,610,179 | 10/1971 | Shaw, Jr. et al. . | |
| 3,651,771 | 3/1972 | Eberle . | |
| 3,664,277 | 5/1972 | Chatterjee et al. . | |
| 3,680,500 | 8/1972 | Pryor . | |
| 3,941,065 | 3/1976 | Albrecht | 110/252 X |
| 4,013,023 | 3/1977 | Lombana et al. . | |
| 4,060,041 | 11/1977 | Sowards | 110/346 X |
| 4,182,246 | 1/1980 | Lombana et al. . | |
| 4,385,567 | 5/1983 | Voss | 110/346 X |
| 4,474,121 | 10/1984 | Lewis . | |
| 4,517,906 | 5/1985 | Lewis et al. . | |
| 4,550,669 | 11/1985 | Foresto | 110/315 X |
| 4,744,312 | 5/1988 | Narisoko et al. | 110/346 X |
| 4,777,889 | 10/1988 | Smith | 110/346 X |
| 4,800,824 | 1/1989 | DiFonzo . | |
| 4,870,910 | 10/1989 | Wright et al. . | |
| 4,917,026 | 4/1990 | Greenough | 110/348 X |
| 4,941,415 | 7/1990 | Pope et al. . | |
| 4,976,207 | 12/1990 | Richard et al. . | |
| 5,095,829 | 3/1992 | Nevels . | |
| 5,123,364 | 6/1992 | Gitman et al. . | |
| 5,222,446 | 6/1993 | Edwards et al. . | |
| 5,279,234 | 1/1994 | Bender et al. | 110/346 X |

*Primary Examiner*—Ira S. Lazarus
*Assistant Examiner*—Ljiljana V. Ciric
*Attorney, Agent, or Firm*—Stevens, Davis, Miller & Mosher, L.L.P.

[57] ABSTRACT

A controlled thermal oxidation process for solid combustible waste. The process comprises a first combustion stage wherein the waste is burned in a downward direction from top to bottom. A first, fixed air flow of predetermined volume is passed from bottom to top of the waste. A second, modulated air flow of predetermined lesser volume is passed over the waste and through the combustion flame. The process further comprises a second combustion stage wherein products of combustion from the first stage are exposed to high temperature conditions for a short period of time under 135% to 200% overall stoichiometric air conditions.

6 Claims, 1 Drawing Sheet

CONTROLLED THERMAL OXIDATION PROCESS FOR ORGANIC WASTES

BACKGROUND OF THE INVENTION

The present invention relates to thermal oxidation of waste, and more particularly to a controlled process for two stage thermal oxidation of selected solid wastes to significantly reduce targeted air emissions.

The process of two stage combustion is an old art in which combustible materials are normally burned under substoichiometric conditions in the first stage chamber to produce combustible gases and ash. The resultant combustible gases are further mixed with air and burned under superstoichiometric conditions in the second stage.

The control of two stage combustion is typified in U.S. Pat. Nos. 4,013,203 and 4,182,246 wherein reverse action air control and auxiliary fuel fired burners are used to control first stage operating temperatures within a specified range while concurrently assuring substoichiometric conditions by further over-riding air and auxiliary burner requirements, when necessary, to maintain a certain oxygen content in the combustible gases passing into the secondary stage. The second stage temperature is controlled by direct mode since an increase in secondary temperature results in an increase in air flow causing quenching effects on combusting gases and lower temperature. A further complication is encountered in temperature control when air flow requirements are over-ridden and increased whenever a certain minimum level of oxygen is not maintained in the secondary exit gasses.

Improvements for the control of typified two stage combustion systems are documented in U.S. Pat. No. , 4,474,121 which concentrates on assuring substoichiometric conditions in the first stage and controlled superstoichiometric air rates in the second stage which in essence eliminates any requirement for oxygen monitoring of first stage exit gases and provides for substantially better control of the combustion process compared to earlier technologies.

Other patents of general background interest, describing and illustrating waste incineration methods and apparatus, include:

| | | |
|---|---|---|
| U.S. Pat. No. 3,595,181 | Anderson et al. | July 27, 1971 |
| U.S. Pat. No. 3,610,179 | Shaw, Jr. et al. | October 5, 1971 |
| U.S. Pat. No. 3,651,771 | Eberle et al. | March 28, 1972 |
| U.S. Pat. No. 3,664,277 | Chatterjee et al. | May 23, 1972 |
| U.S. Pat. No. 3,680,500 | Pryor et al. | August 1, 1972 |
| U.S. Pat. No. 4,517,906 | Lewis et al. | May 21, 1985 |
| U.S. Pat. No. 4,800,824 | DiFonzo et al. | January 31, 1989 |
| U.S. Pat. No. 4,870,910 | Wright et al. | October 3, 1989 |
| U.S. Pat. No. 4,941,415 | Pope et al. | July 17, 1990 |
| U.S. Pat. No. 4,976,207 | Richard et al. | December 11, 1990 |
| U.S. Pat. No. 5,095,829 | Nevels et al. | March 17, 1992 |
| U.S. Pat. No. 5,123,364 | Gitman et al. | June 23, 1992 |
| U.S. Pat. No. 5,222,446 | Edwards et al. | June 29, 1993 |

These typified control systems do not address the air emission problems associated with highly variable air flow rates passing through the combusting materials within the first stage which can cause dramatic increases in ash particulate entrainment and necessitate the use of particulate removal systems before exhaust gases can exit into heat exchangers or the atmosphere. The constant fouling of analytical instruments used to monitor the composition of first stage exist gases results in inaccurate readings and necessitates constant vigilance and maintenance to provide the desired process control.

Accordingly it is an object of the present invention to provide a combustion oxidation process which is adapted to meet specific, internationally acceptable air quality assurances without the necessity of costly exhaust gas scrubbing and filtration to remove organic compounds and solid particulates.

SUMMARY OF THE INVENTION

In accordance with the present invention there is provided a controlled thermal oxidation process for solid combustible waste. The process comprises a first combustion stage wherein the waste is burned in a downward direction from top to bottom. A first, fixed air flow of predetermined volume is passed from bottom to top of the waste. A second, modulated air flow of predetermined lesser volume is passed over the waste and through the combustion flame. The process further comprises a second combustion stage wherein products of combustion from the first stage are exposed to high temperature conditions for a short period of time under 135% to 200% overall stoichiometric air conditions.

It is preferred that in the second combustion stage, the productions of combustion are exposed to a temperature of at least 1832° F. for at least two seconds.

The process is particularly well suited to solid waste wherein the waste has a maximum moisture content of about 60% by weight and a minimum average higher heating value of about 4000 BTU per pound and a maximum combined moisture and non-combustible contents of about 57% by weight.

The process according to the present invention provides for substantially complete oxidation of organic compositions released from the burning solid waste materials and those inherently synthesized during the combustion process, i.e. dioxins and furans.

BRIEF DESCRIPTION OF THE DRAWINGS

These and other advantages of the invention will become apparent upon reading the following detailed description and upon referring to the drawings in which.

Figure 1:
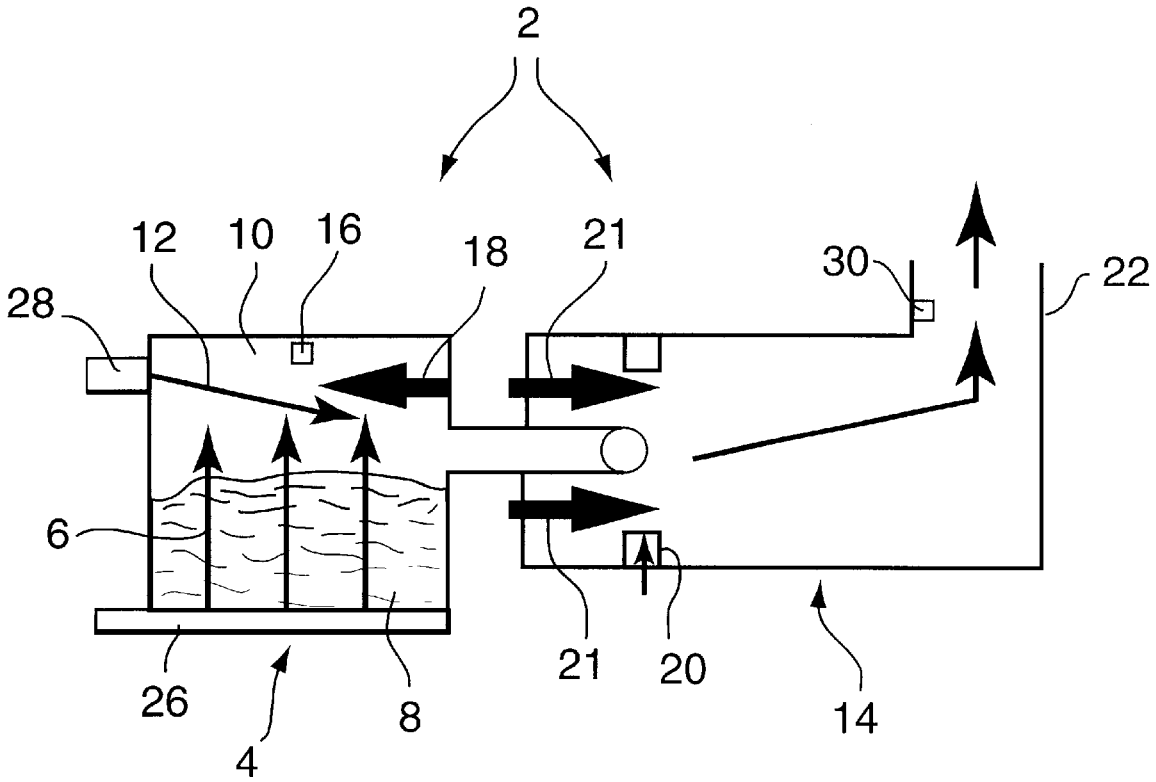
FIG. 1 is a schematic view of a combustion chamber arrangement for carrying out the process of the present invention.

While the invention will be described in conjunction with an example embodiment, it will be understood that it is not intended to limit the invention to such embodiment. On the contrary, it is intended to cover all alternatives, modifications and equivalents as may be included within the spirit and scope of the invention as defined by the appended claims.

DETAILED DESCRIPTION OF PREFERRED EMBODIMENTS

As illustrated in FIG. 1, the process of the present invention makes use of a two-stage starved air stationary waste batch incinerator 2 wherein, at the primary stage, a primary stage combustion chamber 4 is charged with solid waste of specific minimum and maximum properties with respect to the average higher heating value, moisture content and total noncombustible content. After the initial firing cycle elapse time of one hour, the primary stage is operated only under substoichiometric (less than 100% air) conditions until the burn cycle has been deemed complete. The combustion chamber 4 is fitted with two distinct fresh air supplies, and means to measure and control each air flow independently. The first air flow 6 is of a fixed volume and enters the lower most region of chamber 4 and passes through waste material 8 to be burned, into the upper most region 10 of chamber 4. The second air flow 12 is of variable volume and enters into the upper most region 10 of the chamber above waste material 8. The volume of air for second air flow 12 is not to exceed 50% of first air flow 6. The temperature (T1) of the uppermost region 10, above the burning waste 8 where both air flows combine before exiting into the secondary chamber 14, is measured and recorded by means 16.

This uppermost temperature (T1) is limited to a maximum temperature of 1350° F. and a lower limit of 850° F. as the overriding shutoff limits for the second air flow into the uppermost region of the chamber. There is also provided, for chamber 4, and uppermost area 10, an auxiliary fuel-fired burner 18 to provide initial firing of the solid waste material at its upper limits and ensure that the burn continues in an unconventional downward direction to completion.

The combustion process in chamber 4 is deemed substantially complete when combustion gases in the uppermost area 10 of chamber 4 have attained a T1 temperature of 1150° F., after the first hour of cycle time and after a further period of time, T1 temperature has lowered to 850° F.

For the second stage combustion in secondary chamber 14, means 20 is provided to mix fresh air with combustion gases entering from the primary chamber 4. Those mixed gases are exposed to a temperature, in secondary chamber 14, of at least 1832° F. from burners 21, and further combustion is thereby caused. A minimum of two seconds residence time is provided for all products of combustion in secondary chamber 14, before exiting into stack 22.

The process according to the present invention provides for overall stochiometric air conditions ranging from 135% to 200% as normally expected from two stage combustion.

The waste to be used in accordance with the process of the present invention is restricted to waste categories demonstrating a sufficient average higher heating value, including water and non-combustible materials, to support self-contained sub-stoichiometric combustion within the primary stage combustion chamber 4, without a requirement for supplementary heat energy from auxiliary fuel-fired burners, other than to initiate combustion. More particularly, it is preferred that the solid waste materials have minimum and maximum characteristics identified as:

- having a maximum moisture content of 60% by weight
- having a minimum average higher heating value of about 4,000 BTU/lb
- having a maximum combined moisture and non-combustible content of about 57% by weight.

It has been found that the stack air emission quality when such waste is burned according to the process of the present invention, has an improved quality as represented by:

- solid particulate entrainment in exhaust gases of less than 10 mg/dscm
- TOC organic compounds (as C) in exhaust gases of less than 10 mg/dscm
- dioxins and furans in exhaust gases of less than 0.10 ng/dscm as I-TEQ (toxic equivalents)
- CO content of exhaust gases less than 50 mg/dscm
- $NO_x$ content of exhaust gases less than 210 mg/dscm.

The process according to the present invention can economically process up to 50 tonnes of solid waste for a twenty-four hour period and produce up to 25 million BTU per hour of clean, useful heat energy per combustion unit.

The process according to the present invention provides for two distinct air flows in the primary chamber 4, the first air flow of being fixed and of higher volume and entering through the bottom of the chamber and passing through the solid waste 8 and subsequent ash layer. The second air flow is modulated and of lower volume entering from the top of the chamber so as to not pass through the waste or any ash layer but passing through the flame, causing further combustion of gases and providing additional heat release into the primary chamber. The result of these two distinct air flows improves combustion control significantly by:

(a) reducing particulate entrainment due to low fixed volumes of air passing through the waste and upper ash layer for a wide range of combustion gas temperatures before exiting the primary stage;

(b) lowering combustion zone temperature within the waste due to low fixed volumes of air preventing the formation of slag and fused materials and facilitating recycling of ash components;

(c) increasing combustion gas temperature within the upper most area of the primary chamber by use of a second variable air flow, without increasing the air flow through the waste;

(d) providing a more consistent volume and temperature of combustion gases exiting the primary chamber and entering the secondary chamber.

EXAMPLES

An existing two stage thermal oxidizer manufactured by Eco Waste Solutions Inc., having a primary stage internal capacity of 343 cubic feet and measuring 7 ft.×7 ft×7 ft., was modified to provide two separate fresh air inlets into the first stage combustion chamber 4, as in FIG. 1 and with means 26 and 28 to measure, record and control each air flow independently as in accordance with the present invention. The first stage combustion chamber had the means to measure and record the temperature of combusted gases (T1) in its upper most region. The second stage chamber 14 had a total internal volume of 198 cubic feet and capable of providing a residence time for all products of combustion exceeding 2 seconds at a minimum temperature of 1832° F. before exiting to the stack. The stack entrance temperature (T2) was measured, and recorded at 30, and controlled by two oil fired burners 21 located at the opposite end of the secondary chamber.

All test burns were carried out using the incineration/oxidation system just described and pictured in FIG. 1.

Initial burns, using pre-blended heterogeneous Municipal Solid Waste (MSW) with a Higher Value of about 4,300 BTU/lb. and without top air, were carried out to determine the maximum bottom air flow rate that would yield stack exhaust particulate levels below 10 mg/dscm when calculated at 11% oxygen content to the stack. A total of three burns were evaluated for in stack particulate levels over 3 hour periods during each burn with the results in Table 1.

TABLE 1

| Burn # | Total Wt. | Burn Time | Fixed, Bottom Air Flow Rate | % Ash | Particulate |
|---|---|---|---|---|---|
| 1 | 1600 lb | 6 hours | 30 scfm | 6.0% | 6.2 mg/dscm |
| 2 | 1800 lb | 7 hours | 33 scfm | 8.4% | 8.1 mg/dscm |
| 3 | 2400 lb | 9 hours | 37 scfm | 6.5% | 10.1 mg/dscm |

From Table 1 a standard bottom air flow rate of 30 scfm or less was deemed to provide sufficient margin to ensure stack particulate levels lower than 10 mg./dscm. The bottom air flow rate of 30 scfm corresponds to an air flow rate of 0.61 dscf per square foot of primary chamber floor area (floor area was 49 sq. ft.).

A second series of test burns using MSW as the waste material were carried out to determine the differences in process conditions when:

(a) Burn #4, bottom air flows were not controlled and determined by natural stack draft only and no top air was added;

(b) Burn #5, bottom air was set at a fixed rate and no top air was added;

(c) Burn #6, bottom air was set at a fixed rate and top air was added in incremental volumes to a maximum 50% of bottom air.

The time, temperature (T1) and air flows for test burns #4, #5, and #6 are as outlined in Table 2, noting that all waste consumed in these burns was pre-blended to provide reasonable consistency with respect to a thermal value of approximately 4,700 BTU/lb and charge weights of 1,850 lb. to 1,870 lb. for each burn.

TABLE 2

| | BURN #4 | | BURN #5 | | BURN #6 | | |
|---|---|---|---|---|---|---|---|
| Elapse Time - minutes | T1 Temp. - (F.) | Total Bottom Air - scfm | T1 Temp. - (F.) | Total Bottom Air - scfm | T1 Temp. - (F.) | Total Bottom Air - scfm | Total Top Air - scfm |
| 0 | 80 | 24 | 87 | 30 | 81 | 30 | 0 |
| 15 | 1200 | 27 | 1197 | 30 | 1202 | 30 | 0 |
| 30 | 1107 | 35 | 1122 | 30 | 1080 | 30 | 0 |
| 45 | 1038 | 45 | 1021 | 30 | 1048 | 30 | 3 |
| 60 | 976 | 45 | 953 | 30 | 1030 | 30 | 3 |
| 75 | 967 | 45 | 948 | 30 | 1055 | 30 | 6 |
| 90 | 965 | 45 | 941 | 30 | 1080 | 30 | 6 |
| 105 | 963 | 45 | 940 | 30 | 1102 | 30 | 9 |
| 120 | 958 | 46 | 960 | 30 | 1135 | 30 | 9 |
| 150 | 958 | 47 | 967 | 30 | 1182 | 30 | 9 |
| 180 | 1050 | 49 | 993 | 30 | 1231 | 30 | 12 |
| 210 | 1185 | 49 | 1047 | 30 | 1238 | 30 | 12 |
| 240 | 1245 | 47 | 1120 | 30 | 1237 | 30 | 12 |
| 270 | 1247 | 46 | 1162 | 30 | 1221 | 30 | 15 |
| 300 | 1250 | 46 | 1190 | 30 | 1202 | 30 | 15 |
| 330 | 1230 | 47 | 1203 | 30 | 1197 | 30 | 15 |
| 360 | 1180 | 44 | 1192 | 30 | 1173 | 30 | 15 |
| 390 | 1138 | 43 | 1160 | 30 | 1107 | 30 | 15 |
| 420 | 1030 | 45 | 1137 | 30 | 958 | 30 | 15 |
| 450 | 988 | 46 | 1130 | 30 | 880 | 30 | 0 |
| 480 | 938 | 44 | 1038 | 30 | 851 | 30 | 0 |
| 510 | 899 | 45 | 988 | 30 | 842 | 30 | 0 |
| 540 | 873 | 43 | 938 | 30 | 830 | 30 | 0 |
| 570 | 849 | 44 | 899 | 30 | 821 | 30 | 0 |
| 600 | 821 | 44 | 845 | 30 | 811 | 30 | 0 |
| Burn Rate | 195 lb/hr | | 186 lb/hr | | 232 lb/hr | | |

TABLE 2-continued

| | BURN #4 | | BURN #5 | | BURN #6 | | |
|---|---|---|---|---|---|---|---|
| Elapse Time - minutes | T1 Temp. - (F.) | Total Bottom Air - scfm | T1 Temp. - (F.) | Total Bottom Air - scfm | T1 Temp. - (F.) | Total Bottom Air - scfm | Total Top Air - scfm |
| % Ash & Residuals | 7.20% | | 7.10% | | 7.40% | | |
| Burn cycle time | 570 minutes | | 600 minutes | | 480 minutes | | |

NOTE:
Burn cycle was considered substantially complete when T1 reached a minimum of 1150 degrees Fahrenheit for a period of time after the first hour of cycle time and after a still further period of time reached 850 degrees Fahrenheit.

The time, temperature, and air flow conditions as established during burns #4 through #6 clearly indicate the following:

1. A combination of bottom and top air into the primary combustion stage as in burn #6, significantly increased the rate at which solid waste was consumed and resulted in a 15% to 20% reduction in cycle time when compared to burns #4 and #5;
2. T1 operating temperatures in burn #6, for this waste category, were attained much earlier in the cycle of burn #6 and possibly contributed significantly to the reduced cycle time of that burn;
3. Particulate levels contained in stack exhaust gases, taken over a 3 hour period during each burn (#4, #5 and #6) and starting at a point three hours into each cycle demonstrated average particulate levels as follows:
   In Stack Particulate Level
   Burn #4—17.3 mg/dscm calculated to 11% oxygen
   Burn #5—8.6 mg/dscm calculated to 11% oxygen
   Burn #6—9.2 mg/dscm calculated to 11% oxygen;
4. The results indicated here, comparing burn #4 and #5, further demonstrate that bottom fed primary combustion stage air supply contributes significantly to the amount of particulate contained in stack exhaust gases;
5. In comparing particulate levels measured in burns #5 and #6, it is also demonstrated that when the bottom air flow rate is fixed, it is possible to add an additional amount of air into the top area of the primary combustion stage chamber equivalent to at least half the amount of bottom fed air without severely affecting stack exhaust particulate levels.

A third series of test burns were carried out to determine that when no top air is added and a maximum bottom air flow rate of 30 scfm (equivalent to 0.61 scfm per square foot of primary stage floor area) and at T1 temperatures in the range of from 850 to 1350 degrees Fahrenheit, a significant range of solid waste materials, having distinctly different average higher heating values, could support self sustained substoichiometric combustion in a top to bottom direction through the waste within the primary stage and further establish an appropriate fixed bottom air flow for each waste material. Table 3 lists the materials combusted during this series of individual test burns #7 through #12 and the individual properties of each waste. Table 4 lists the conditions established during burns #7 through #12 and stack air emissions test results obtained during each burn.

TABLE 3

| Burn # | Waste Material | Estimated Average HHV | % Moisture | % Ash |
|---|---|---|---|---|
| 7 | Plastic (PBVC) | 18,000 BTU/lb. | ~1% | ~.1% |
| 8 | Tires | 11,870 BTU/lb. | ~1% | ~7% |
| 9 | Mix of Tires/ Wood/MSW | 8,500 BTU/lb. | ~10% | ~5% |
| 10 | MSW | 4,300 BTU/lb | ~50% | ~7% |
| 11 | MSW | 3,500 BTU/lb | ~60% | ~7% |
| 12 | MSW | 2,500 BTU/lb | ~70% | ~5% |

TABLE 4

| Burn # | Charge Weight lb | T1 after 60 minutes F. | T1 Maximum F. | Top Air Flow Rate scfm | Bottom Air Flow Rate scfm | Burn Rate lb/hour | Cycle Time hours | In Stack Particulate mg/dscm |
|---|---|---|---|---|---|---|---|---|
| #7 | 400 | 865 | 1250 | 0 | 28 | 94 | 4.25 | 2 |
| #8 | 936 | 870 | 1285 | 0 | 9 | 185 | 5 | 7.1 |
| #9 | 1225 | 1012 | 1285 | 0 | 20 | 204 | 6 | 6.3 |
| #10 | 1260 | 972 | 1250 | 0 | 30 | 194 | 6.5 | 7.9 |
| #11 | 1253 | 849 | 1190 | 0 | 5 to 43 | 156 | 8 | 11.7 |
| #12 | 1271 | 849 | 1178 | 0 | 0 to 39 | 130 | 9.75 | 11.3 |

Test burns #7, #8, #9, #10 demonstrated the ability to combust a variety of waste materials under the primary stage parameters and conditions as previously set out, and were deemed as applicable to the invention due to their conformity to the basic requirements of the invention of:

1. substoichiometric combustion;
2. total bottom air flow volume of less than or equal to 30 scfm;
3. self-sustained combustion and in a downward direction through the waste and within the T1 temperature range of from 850 to 1350 degrees Fahrenheit;
4. maximum in stack particulate levels of 10 mg/dscf or less.

Test burns #11 and #12 both required multiple firings of the primary stage auxiliary fuel burner to maintain a minimum T1 temperature of 850° Fahrenheit during the first 3 hours of the burn cycle and therefore did not meet the required parameter of self sustained combustion. Both of these burns required multiple adjustments of bottom air flow volumes in an attempt to maintain temperatures within the desired range and a fixed bottom air flow rate could not be achieved until approximately half-way through the cycle. It was further observed that on several occasions during both burns it was necessary to provide superstoichiometric conditions (greater than 100% air) within the primary stage to maintain combustion. Properties the solid waste used in burns #11 and #12 were considered as being unsuitable for the process of this invention and these properties being determined as:

1. a solid waste having a moisture content of approximately 60% or greater;
2. a solid waste having an average Higher Heating Value of about 3,500 BTU/lb or less;
3. a solid waste having a combined moisture and non-combustible content of greater than about 57% by weight.

A further series of seven test burns were carried out to provide examples in full compliance with the main invention and furthermore made use of the solid waste parameters developed from burns #7 through #12.

Table #5 outlines the properties of each solid waste material used in examples of the invention.

TABLE 5

| Example # | Waste Material | Estimated Average HHV BTU/lb | Moisture Content % by weight | Residual Ash % by weight | Total Charged Weight - lb |
|---|---|---|---|---|---|
| #1 | plastic | ~18000 | ~1 | ~.1 | 800 |
| #2 | tires | ~11870 | ~1 | ~7 | 720 |
| #3 | mixture | ~7,600 | ~12 | ~5 | 1390 |
| #4 | MSW | ~6,000 | ~25 | ~7 | 1425 |
| #5 | MSW | ~5,000 | ~45 | ~7 | 1385 |
| #6 | MSW | ~4,500 | ~50 | ~7 | 1400 |
| #7 | MSW | ~4,000 | ~55 | ~7 | 1390 |

Table 6 outlines the observed and measured conditions during each of the example bums #1 through #7.

TABLE 6

| Example # | Burn # | T1 after 60 Minutes F | T1 Maximum F | Top Air Flow Rate Max. scfm | Bottom Air Flow Rate Fixed scfm | Burn Rate lb/hour | Cycle Time hours |
|---|---|---|---|---|---|---|---|
| #1 | #13 | 955 | 1342 | 14 | 28 | 109.6 | 7.3 |
| #2 | #14 | 1200 | 1304 | 4 | 8 | 218 | 3.3 |
| #3 | #15 | 1047 | 1297 | 13 | 27 | 232 | 6 |

TABLE 6-continued

| Example # | Burn # | T1 after 60 Minutes F | T1 Maximum F | Top Air Flow Rate Max. scfm | Bottom Air Flow Rate Fixed scfm | Burn Rate lb/hour | Cycle Time hours |
|---|---|---|---|---|---|---|---|
| #4 | #16 | 1049 | 1292 | 15 | 30 | 227 | 6.3 |
| #5 | #17 | 1047 | 1298 | 15 | 30 | 226 | 6.1 |
| #6 | #18 | 984 | 1286 | 15 | 30 | 219 | 6.4 |
| #7 | #19 | 978 | 1289 | 15 | 30 | 214 | 6.5 |

Table 7 itemizes the stack emission levels recorded for example 1 through 7.

TABLE 7

| Example # | Oxygen Content % | Nox mg/dscm @ 11% O2 | CO mg/dscm @ 11% O2 | CO2 mg/dscm @ 11% O2 | Dioxins/ Furans ng/dscm | Particulate mg/dscm @ 11% O2 | TOC mg/dscm @ 11% O2 |
|---|---|---|---|---|---|---|---|
| #1 | 9.4 | 36.5 | 0.55 | 9.6 | 0.043 | 5.2 | 1.7 |
| #2 | 8.9 | 66.7 | 1.4 | 9.3 | 0.0614 | 9.3 | 8.2 |
| #3 | 9 | 40.2 | 0.84 | 9.4 | 0.0243 | 8.1 | 5.8 |
| #4 | 8.9 | 55.4 | 1.08 | 9.3 | 0.0195 | 6.2 | 4.8 |
| #5 | 9.7 | 26.8 | 0.1 | 9.6 | 0.0229 | 8.2 | 1.6 |
| #6 | 9.2 | 40.7 | 0.6 | 9.4 | 0.027 | 8.8 | 3.8 |
| #7 | 9.3 | 44.7 | 0.88 | 9.4 | 0.0334 | 7.7 | 3.9 |

In examples 1 through 7 it is clearly demonstrated that the two stage combustion process claimed and as earlier described, has provided for the combustion of a variety of solid waste materials having certain minimum and maximum characteristics identified as:

1. having a maximum moisture content of 60% by weight;
2. having a minimum average Higher Heating Value of about 4,000 BTU/lb;
3. having a maximum combined moisture and non-combustible content of about 57% by weight.

And, furthermore, said two-stage combustion process has provided for certain improvements in stack air emission quality as claimed of:

1. solid particulate emissions of less than 10 mg/dscm
2. TOC, organic compounds as carbon emissions of less than 10 mg/dscm
3. Dioxin and Furan emissions of less than 0.10 ng/dscm as I-TEQ toxic equivalents
4. CO, carbon monoxide emissions of less than 50 mg/dscm
5. NOx, oxides of nitrogen emissions of less than 210 mg/dscm and said low levels of air emissions have been achieved without the use of conventional exhaust gas scrubbing and filtration systems.

These air emissions comply with all current international standards for particulate levels, Nox, CO, organic components (such as carbon) and dioxin/furan levels without the aid of bag houses or scrubbers.

Thus, it is apparent that there has been provided in accordance with the invention a controlled process for two stage thermal oxidation of selected solid wates that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What is claimed is:

1. A controlled thermal oxidation process for combustible solid waste, the process comprising:

a first combustion stage wherein the waste is burned in a downward direction from top to bottom, a first fixed air flow of predetermined volume is passed from bottom to top of the waste, and a second modulated air flow of predetermined lesser volume is passed over the waste and through the combustion flame; and a second combustion stage wherein products of combustion from the first combustion stage are exposed to high temperature conditions for a short period of time under 135% to 200% overall stoichiometric air conditions.

2. A process according to claim 1 wherein, in the second combustion stage, the productions of combustion are exposed to a temperature of at least 1832° F. for at least two seconds.

3. A process according to claim 1, wherein the waste has a maximum moisture content of about 60% by weight and a minimum average higher heating value of about 4000 BTU per pound and a maximum combined moisture and non-combustible contents of about 57% by weight.

4. A process according to claim 2, wherein the waste has a maximum moisture content of about 60% by weight and a minimum average higher heating value of about 4000 BTU per pound and a maximum combined moisture and non-combustible contents of about 57% by weight.

5. A process according to claim 1 wherein the first air flow of the first combustion stage has a maximum flow rate of about 0.61 standard cubic feet per minute of fresh air per square foot of primary stage chamber floor area.

6. A process according to claim 5 wherein the second air flow is of a volume not to exceed 50% of the first air flow.

* * * * *